US008215742B2

(12) United States Patent
Nakata

(10) Patent No.: US 8,215,742 B2
(45) Date of Patent: Jul. 10, 2012

(54) RECORDING APPARATUS

(75) Inventor: Toshio Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 285 days.

(21) Appl. No.: 12/757,564

(22) Filed: Apr. 9, 2010

(65) Prior Publication Data

US 2010/0259577 A1 Oct. 14, 2010

(30) Foreign Application Priority Data

Apr. 13, 2009 (JP) ..... 2009-097194

(51) Int. Cl.
*B41J 29/38* (2006.01)

(52) U.S. Cl. ..... 347/16; 347/5; 347/104

(58) Field of Classification Search ..... 347/5, 14, 347/16, 19, 101, 104–107
See application file for complete search history.

(56) References Cited

U.S. PATENT DOCUMENTS

| | | | | |
|---|---|---|---|---|
| 6,017,114 | A * | 1/2000 | Elgee et al. | 347/40 |
| 7,549,721 | B2 | 6/2009 | Nakano et al. | |
| 2009/0023743 | A1 | 1/2009 | Michaelides et al. | |

FOREIGN PATENT DOCUMENTS

| | | | |
|---|---|---|---|
| JP | 2007-261262 | A | 3/2007 |
| JP | 2007-062162 | A | 10/2007 |
| JP | 2009-066871 | A | 4/2009 |

* cited by examiner

*Primary Examiner* — Juanita D Jackson
(74) *Attorney, Agent, or Firm* — Workman Nydegger

(57) ABSTRACT

A recording apparatus includes: a driving unit that drives the transporting unit; a phase detecting unit that detects a phase origin of the transport roller rotating in accordance with the driving of the driving unit and a rotational phase indicating an amount of rotation from the phase origin; a recording unit that performs recording on the sheet transported with the transporting unit; and a control unit that controls the driving unit such that the transport roller rotates within a certain transport range based on a preliminarily set reference phase, forms a first pattern by controlling the recording unit at a first rotation phase at a control start point of the driving unit, forms a second pattern by controlling the recording unit at a second rotation phase at a control end point of the driving unit, and then forms a correction pattern including the first and second patterns.

1 Claim, 8 Drawing Sheets

RECORDING APPARATUS

BACKGROUND

1. Technical Field

The present invention relates to a recording apparatus such as an ink jet printer and to a method for recording a correction pattern.

2. Related Art

In the related art, an ink jet printer (hereinafter referred to as a "printer") is widely known as a recording apparatus that performs recording onto a sheet transported by a sheet transporting device (hereinafter referred to as a "transporting device", simply). In the transporting device in the printer, a sheet is intermittently transported at a predetermined transport rate by controlling the amount of rotation of a transport roller based on the detection result of a rotary encoder disposed coaxially with the transport roller which rotates to transport the sheet in a sub-scanning direction (transport direction).

Meanwhile, the printers individually have individual differences in a transport rate of a sheet transported by the rotation of the transport roller due to an error in alignment or the like therein. Furthermore, in the case where the rotational center of a disk-shaped, scaled encoder scale in the rotary encoder is misaligned with the center of the disk-shaped encoder scale, such individual differences in the transport rate of the sheet in every printer may appear as different detection results depending on a position at which the scale has been detected (transport rate error).

Accordingly, in a printer in JP-A-2007-261262, two positions displaced from each other by 180 degrees in a circumferential direction of a disk-shaped encoder scale are determined to individually measure transport rates of a sheet on the basis of the two positions, and then each transport rate measured at the two positions is averaged to estimate the transport rate of the sheet during a single rotation of a transport roller. Then, correction to reduce variation in the transport rate of the sheet, which results from the individual differences in each printer, is performed on the basis of the transport rate of the sheet which has been estimated in this manner.

Unfortunately, in the printer disclosed in JP-A 2007-261262, a transport rate of a sheet is calculated at a plurality of positions (for example, two positions) in the circumferential direction of the encoder scale, and significantly many processes must be performed to obtain the individual differences in the transport rate of the sheet in every printer.

SUMMARY

An advantage of some aspects of the invention is to provide a recording apparatus and a method for recording a correction pattern, which both enable individual differences in a transport rate of a sheet to be easily measured.

According to an aspect of the invention, there is provided a recording apparatus which includes: a transporting unit that transports a sheet in a transport direction from an upstream side to a downstream side with a transport roller; a driving unit that drives the transporting unit; a phase detecting unit that detects a phase origin of the transport roller which rotates in accordance with the driving of the driving unit and detects a rotational phase indicating an amount of rotation from the phase origin; a recording unit that performs recording onto the sheet transported by the transporting unit; and a control unit that controls the driving unit such that the transport roller rotates within a certain transport range base on a preliminarily set reference phase, forms a first pattern by controlling the recording unit at a first rotation phase at a control start point of the driving unit, forms a second pattern by controlling the recording unit at a second rotation phase at a control end point of the driving unit, and then forms a correction pattern including the first and second patterns.

According to this configuration, because the correction pattern is formed on the basis of the reference phase, even though an error of the transport rate of the sheet transported by the transport roller is changed, the transport rate of the sheet transported by a single rotation of the transport roller can be obtained from one correction pattern formed with reference to one position. Namely, the correction pattern, which enables the transport rate corresponding to a single rotation of the transport roller to be estimated, can be formed without actually rotating the transport roller by 360 degrees. Consequently, each individual difference in the transport rate of the sheet in each apparatus can easily be measured.

The recording apparatus further includes a storage unit that stores a rotational phase as the reference phase, the rotational phase to be stored being out of phase by a quarter cycle relative to the rotational phase having a maximum transport rate error of the sheet, the transport rate error varying with a cycle of a single rotation of the transport roller.

The variation in the error of the transport rate of the sheet in a cycle of a single rotation of the transport roller results from the error in alignment of the rotation center of the transport roller or the like and is inherent in the apparatus. Accordingly, the reference phase of the transport roller is also uniquely determined in individual apparatuses, the reference phase being determined on the basis of the variation in the error of the transport rate. On the other hand, the transport rate of the sheet transported by a single rotation of the transport roller depends on, for example, conditions in which the roller abuts on the sheet or the like, so that the transport rate is changed depending on recording conditions. Accordingly, the reference phase inherent in an apparatus is stored in the storage unit, so that the reference phase stored in the storage unit can be used in every formation of the correction pattern with the result that the correction pattern can easily be formed.

The storage unit in the recording apparatus stores two different rotational phases as the reference phase in a single rotation of the transport roller, so that the controlling unit controls the driving unit on the basis of one of the two different reference phases stored in the storage unit.

According to this configuration, because a sheet is transported on the basis of one of the two reference phases, unnecessary transport of the sheet can be suppressed, for example, by using a nearer reference phase in a rotational direction of the transport roller. Consequently, the consumption of the sheet can be suppressed.

According to another aspect of the invention, there is provided a method for recording a correction pattern that includes: a first transport process in which a transport roller is rotated so as to be positioned at a first rotational phase to transport a sheet from an upstream side in a transport direction to a recording region in which printing is performed; a first recording process in which a first pattern is recorded on the sheet transported to the recording region; a second transport process in which the transport roller is rotated so as to be positioned at a second rotational phase on the basis of a reference phase to transport the sheet, the reference phase being determined based on an error of the transport rate of the sheet in the transport roller, the transport rate error periodically varying with respect to a rotational phase, and the value of the second rotational phase being the same as that of the first rotational phase with respect to the reference phase; and a second recording process in which a second pattern is recorded on the sheet transported in the second transport process.

According to this configuration, the same effect and advantage can be achieved as in the above recording apparatus according to the invention.

The method for recording a correction pattern of the invention further includes: a rotational process in which the transport roller is rotated by at least 360 degrees; and a reference phase determination process in which the transport rate error of the sheet corresponding to the rotational phase in the rotational process is obtained, so that a rotational phase which is out of phase by a quarter cycle relative to the rotational phase having a maximum transport rate error of the sheet is determined as the reference phase.

According to this configuration, the same effect and advantage can be achieved as in the above recording apparatus according to the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
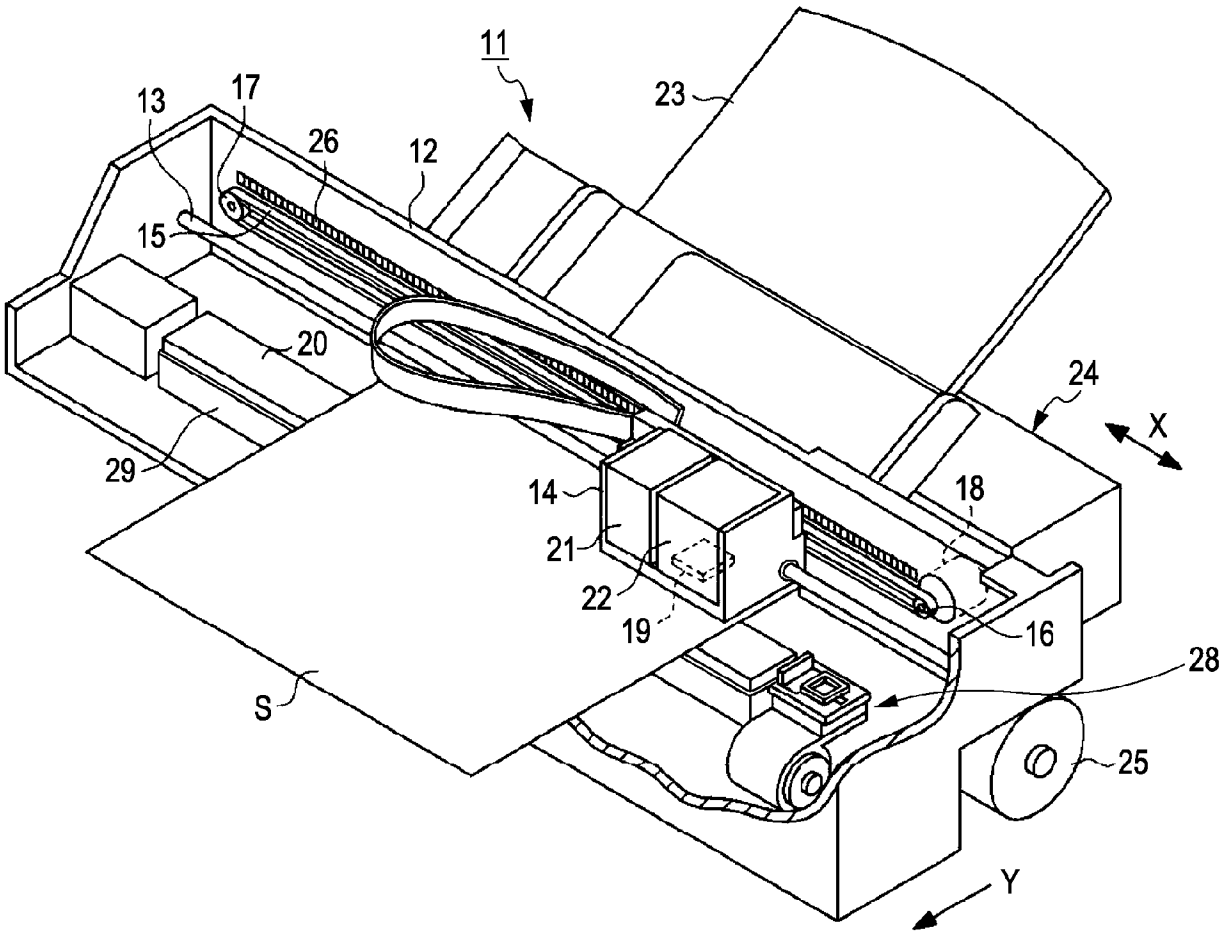
FIG. 1 is a perspective view generally illustrating a printer according to an embodiment of the invention.

An ink jet recording apparatus according to an embodiment of the invention will be described hereinafter with reference to FIGS. 1 to 10. FIG. 1 is a perspective view illustrating the ink jet recording apparatus in a state in which an exterior case thereof is removed. As shown in FIG. 1, the ink jet recording apparatus (hereinafter referred to as a printer 11) as a recording apparatus is provided with a substantially rectangular-shaped body case 12 of which an upper portion is open. A carriage 14 which is disposed so as to be able to being reciprocated in a main-scanning direction (an X direction in FIG. 1) while being guided along a guiding shaft 13 prepared inside the body case 12. A back surface of the carriage 14 is fixed to an endless timing belt 15 which is wound onto a pair of pulleys 16 and 17 disposed on the inner surface of a backboard in the body case 12. A carriage motor (hereinafter referred to as a CR motor 18) having a driving shaft connected to the pulley 16 is normally and reversely driven, so that the carriage 14 is reciprocated in the main-scanning direction X.

A recording head 19 (a recording unit) that ejects ink as a recording material is disposed on a lower portion of the carriage 14. A platen 20 is disposed inside the body case 12 at a lower position facing the recording head 19 while extending in the X direction. The platen 20 defines a distance between the recording head 19 and a sheet S. Ink cartridges 21 and 22 containing black and color ink, respectively, are attachably and detachably disposed on the carriage 14. The recording head 19 has respective nozzles corresponding to each color of inks supplied from each ink cartridge 21 and 22 and ejects (discharges) each color of the inks from the nozzles.

The printer 11 is provided with a paper feed tray 23 and an automatic sheet feeder (Auto Sheet Feeder) 24 on a rear side thereof, and the automatic sheet feeder 24 separates only the top sheet from a plurality of sheets S placed on the paper feed tray 23 to feed the separated sheet in a sub-scanning direction Y (from an upstream side to a downstream side in a transport direction).

A paper feed motor 25 (hereinafter referred to as a PF motor 25) as a driving unit is disposed on the outside of the body case 12 as shown on the lower right side of FIG. 1. The PF motor 25 is driven to drive a paper feed roller 33 of the automatic sheet feeder 24 and a transport device 36 (see FIG. 2 for each), so that the sheet S is transported in the sub-scanning direction Y. Printing operation, in which nozzles of the recording head 19 eject ink onto the sheet S while reciprocating the carriage 14 in the main-scanning direction X, and paper-feed operation, in which the sheet S is transported in the sub-scanning direction Y at a predetermined transport rate, are substantially repeated in turn (note that timing of each operation is partially overlapped), so that letters and images are printed on the sheet S.

A linear encoder 26 is disposed on the printer 11 so as to extend along the guiding shaft 13, and the linear encoder 26 outputs a number of pulses in proportion to a moving distance of the carriage 14. Speed and a position of the carriage 14 are controlled on the basis of a movement position, a movement direction, and movement speed of the carriage 14 which are determined from the pulse output from the linear encoder 26. The printer 11 is provided with a maintenance device 28 that performs cleaning or the like to the recording head 19 to prevent and eliminate nozzle clogging or the like, and the maintenance device 28 is positioned directly below the carriage 14 when the carriage 14 is located at a home position (one end outside of a print region on a movement route of the carriage (right end side in FIG. 1)). A waste tank 29 is disposed under the platen 20 to store the waste ink which the maintenance device 28 has suctioned from the nozzles of the recording head 19.

Figure 2:
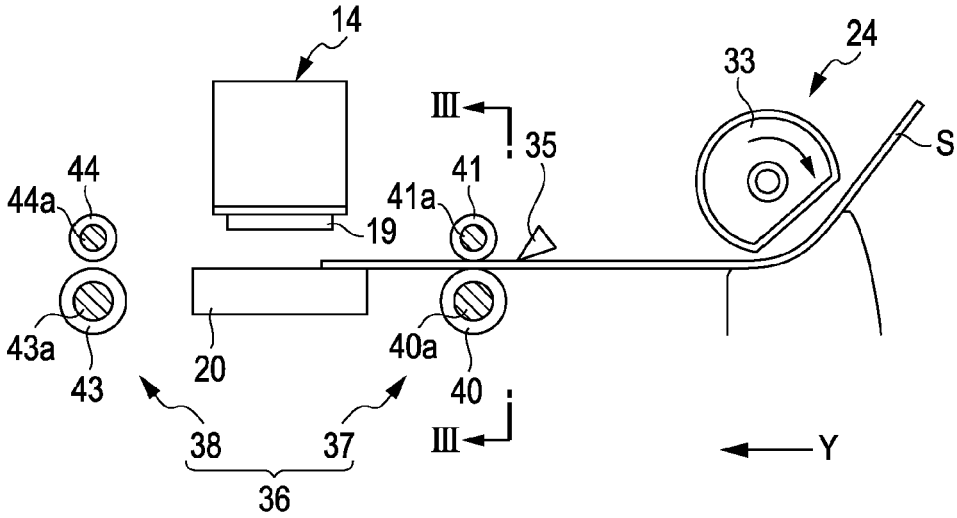
FIG. 2 is a side view schematically illustrating a recording head and a transporting mechanism.

As shown in FIG. 2, a sheet detecting sensor 35 is disposed on a transport path of the sheet S and on a downstream side in the transporting direction (the sub-scanning direction Y) relative to the automatic sheet feeder 24. An example of the sheet detecting sensor 35 is a contact sensor (a switch sensor). The sensor is turned on when an anterior end of the transported sheet S contacts with a detection lever of the sensor to displace the lever, and the sensor is turned off when a spring force of the lever returns the lever to the original standby position after a posterior end of the sheet S has passed the sensor. Because the sheet detecting sensor 35 is used to detect both ends of the sheet S, a non-contact sensor such as an optical sensor may be employed.

As shown in FIG. 2, a transport device 36 has a paper transport roller 37 in a position on an upstream side in the transport direction (the sub-scanning direction Y) relative to the platen 20, and has a paper ejection roller 38 in a position on a downstream side in the transport direction (the sub-scanning direction Y) relative to the platen 20. In the embodiment, the paper transport roller 37 and the paper ejection roller 38 constitute a transporting unit.

Figure 3:
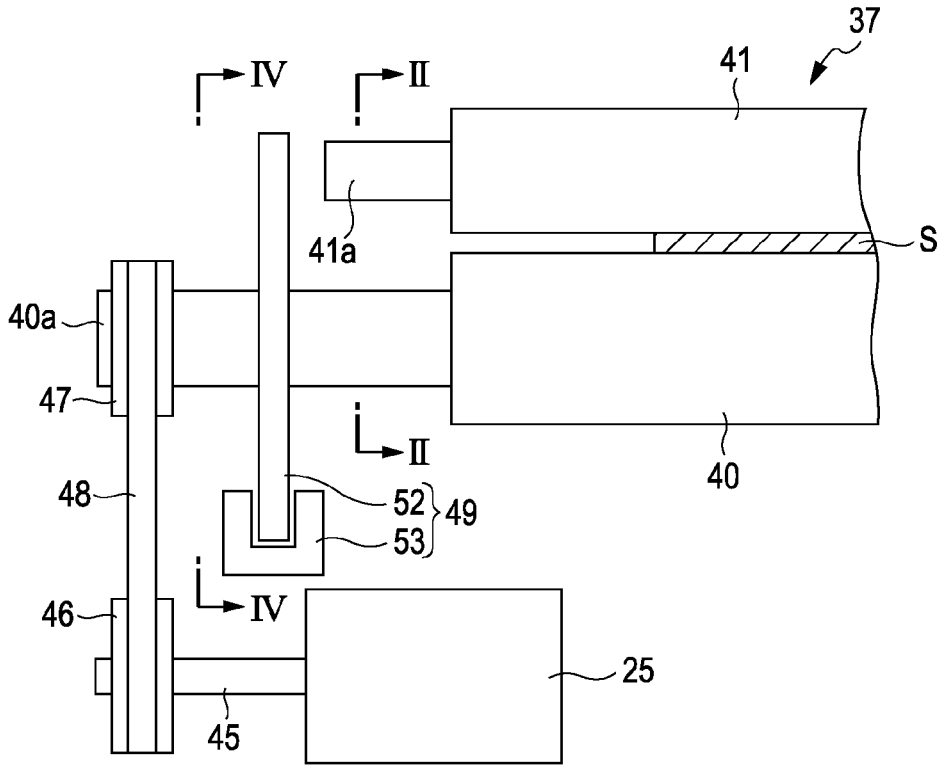
FIG. 3 is a cross sectional view taken along a line in FIG. 2.

As shown in FIGS. 2 and 3, the paper transport roller 37 is provided with a first rotating shaft 40*a* to which the PF motor 25 transmits driving power for rotation, and with a first driving roller 40 as a transport roller which is rotated by the rotary drive of the first rotating shaft 40*a*. A first driven roller 41 which rotates around a first driven shaft 41*a* in conjunction with the rotation of the first driving roller 40 is provided above the first driving roller 40 in combination with the first driving roller 40.

The paper ejection roller 38 is provided with a second rotating shaft 43*a* to which the PF motor 25 transmits driving power for rotation, and with a second driving roller 43 which is rotated by the rotary drive of the second rotating shaft 43*a*. A second driven roller 44 which rotates around a second driven shaft 44*a* in conjunction with the rotation of the second driving roller 43 is provided above the second driving roller 43 in combination with the second driving roller 43.

Shaft bearings (not shown) support each of the first and second rotating shafts 40*a* and 43*a* and each of the first and second driven shafts 41*a* and 44*a*.

As shown in FIG. 3, a driving pulley 46 is fixed to a driving shaft 45 of the PF motor 25 so as to integrally rotate each other. A driven pulley 47 is fixed to the first driving shaft 40*a* so as to integrally rotate each other. An endless power transmission belt 48 is wound onto the driving pulley 46 and the driven pulley 47 to transmit the driving power of the PF motor 25 to the first driving roller 40.

On the side of the paper ejection roller 38, the same configuration as that of the driving pulley 46, the driven pulley 47, and the power transmission belt 48 is provided. Accordingly, when the PF motor 25 is driven, the first driving roller 40 rotates through the driving pulley 46, the driven pulley 47, and the power transmission belt 48, and the second driving roller 43 as well rotates through a driven pulley (not shown) which is provided for the second rotating shaft 43*a* so as to integrally rotate each other.

Figure 4:
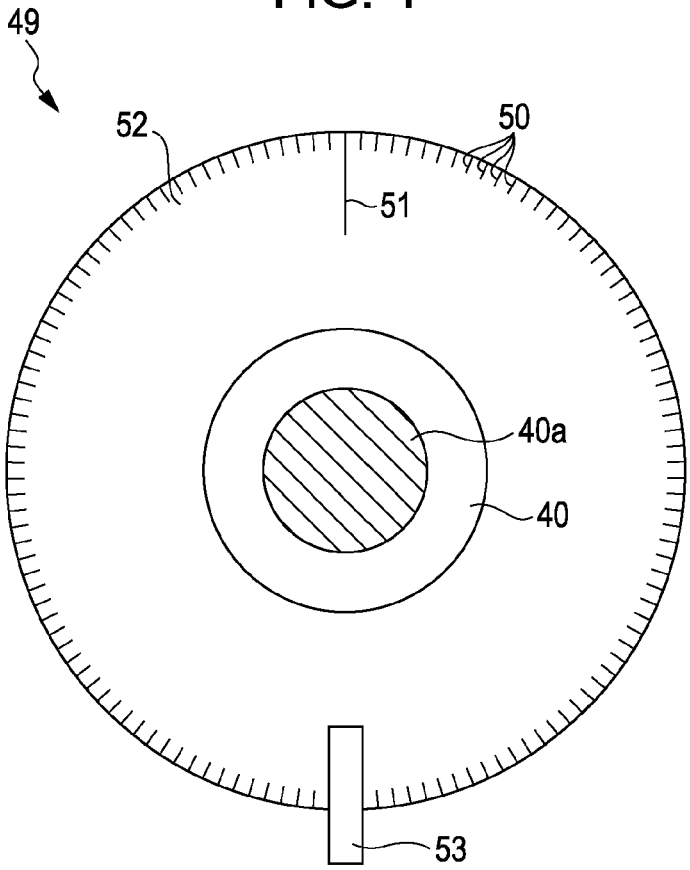
FIG. 4 is a cross sectional view taken along a line IV-IV in FIG. 3.

Further, as shown in FIGS. 3 and 4, the first rotating shaft 40*a* is provided with a rotary encoder 49 as a phase detecting unit which outputs a number of pulses proportion to degrees of a phase in which the first driving roller 40 has rotated. The rotary encoder 49 has a transparent and disk-shaped encoder scale 52 that integrally rotates with the first rotating shaft 40*a* and that is provided with a plurality of scale markings 50 and one origin scale marking 51 which are marked along a periphery thereof. A phase sensor 53 is disposed below the encoder scale 52 so as to face the periphery of the encoder scale 52. The scale markings 50 and the origin scale marking 51 pass the phase sensor 53 as the encode scale 52 rotates, then the phase sensor 53 detects such passing of the markings, thereby outputting pulses corresponding to each detected scale marking.

Namely, the encoder scale 52 rotates such that the origin scale marking 51 comes to a lower position shown in FIG. 4, and then the rotary encoder 49 determines a phase in which the phase sensor 53 has detected the origin scale marking 51 as an origin phase (zero degree) of the first driving roller 40. Furthermore, a rotational phase is capable of being detected from the origin phase (zero degree) on the basis of the number of pulses output after passing the origin phase.

Namely, the first rotating shaft 40*a* rotates to rotate the encoder scale 52; and when the origin scale marking 51 is positioned on the most upper position which the longest distance from the phase sensor 53 as shown in FIG. 4, the rotational phase in this state is 180 degrees.

In the encoder scale 52 shown in FIG. 4, although the scale markings 50 are simply illustrated, it is desirable for the encoder scale 52 to have the scale markings 50 along the periphery thereof at equal intervals so as to be capable of detecting a transport rate of the sheet S approximately in units of micrometers (μm).

Figure 5:
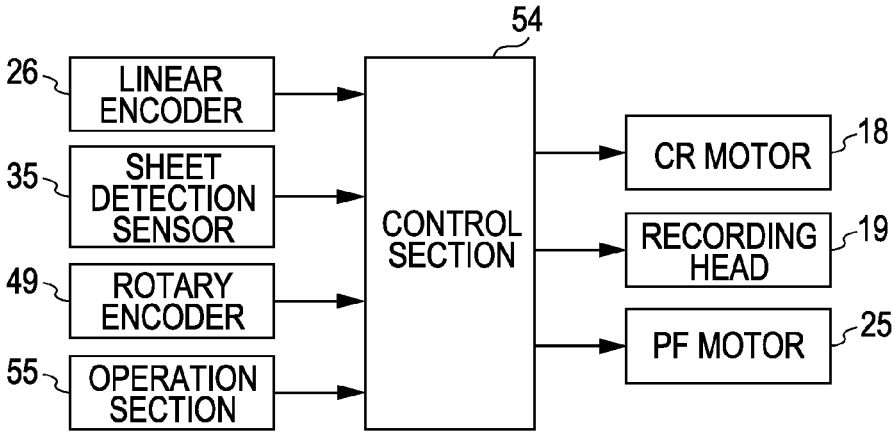
FIG. 5 is a block diagram illustrating a control configuration.

As shown in FIG. 5, the printer 11 has a control section 54 as a storing unit and also as a controlling unit that controls the operation of the printer 11. A linear encoder 26, the sheet detecting sensor 35, and the rotary encoder 49 each output their detection results, and a user operates an operating section 55, so that the control section 54 controls a CR motor 18, the recording head 19, and the PF motor 25 on the basis of the detection results to perform processing such as printing.

A method for forming a measuring pattern P will be described with reference to FIG. 6. The measuring patter P is used for measuring a variation in a transport rate error of the sheet S caused by an error in alignment of the center of the encoder scale 52 or the like.

When an operator operates the operation section 55 to start measuring a transport rate error, a signal for starting measurement of the transport rate error is transmitted to the control section 54. Then, the control section 54 operates to print a plurality of measuring patterns P on a sheet, instructed by a measuring program stored in a read only memory (ROM) (not shown). The method for forming the measuring pattern P in the embodiment will be hereinafter described using an example in which seven measuring patterns P are formed at equal phase intervals (60 degrees) during a single rotation of the first driving roller 40.

Specifically, the control section 54 controls the PF motor 25 to operate, so that the paper feed roller 33, the first driving roller 40, and the second driving roller 43 are rotated. Then, the paper feed roller 33 feeds the sheet S placed on the paper feed tray 23 to the transport device 36, and then the paper transport roller 37 transports the sheet S onto the platen 20

Then, after an anterior end (one end on a downstream side in a transport direction) of the sheet S has passed a print region facing the nozzles arranged on the recording head 19, the control section 54 controls the PF motor 25 to stop the driving of the motor 25 at the timing in which the phase sensor 53 detects the origin scale marking 51. Namely, the first driving roller 40 stops at a rotational phase of zero degree.

Subsequently, the control section 54 controls the CR motor 18 to normally rotate the motor therein, so that the carriage 14 being at a home position is moved in the left direction in FIG. 6. The control section 54 continuously outputs ejection signals to the recording head 19 in conjunction with the leftward movement of the carriage 14 in order to eject black ink from a part of the nozzles corresponding to the black ink. Then, a first measuring pattern P1 being strip-shaped and extending in the main-scanning direction X is formed as shown in FIG. 6.

After finishing the printing of the first measuring pattern P1, the controller 54 drives the PF motor 25. Then the PF motor 25 is made to stop based on the result of detection performed by the rotary encoder 49 such that the first driving roller 40 stops at a rotational phase of 60 degrees. Then, the sheet S is downward transported by a distance D1 in a transport direction (sub-scanning direction Y) indicated by a white arrow, and then stopped.

Then, the control section 54 controls the CR motor 18 to reversely rotate the motor therein, so that the carriage 14, which has been leftward moved and then stopped, is moved in a right direction toward the home position. In this case, the control section 54 continuously transmits the ejection signals to the recording head 19 in order to eject the black ink from the same nozzle which has ejected ink to form the first measuring pattern P1 among the nozzles arranged on the recording head 19. Then, a second measuring pattern P2 being strip-shaped and extending in the main-scanning direction X is formed on the sheet S on a position spaced apart from the first measuring pattern P1 by the distance D1.

After finishing the printing of the measuring pattern P2, the control section 54 drives the PF motor 25 to rotate the first driving roller 40. The first driving roller 40 further rotates by 60 degrees based on the result of the detection performed by the rotary encoder 49 and then stops at a rotational phase of 120 degrees. Then, the sheet S is downward transported by a distance D2 in the transport direction (sub-scanning direction Y) indicated by a white arrow and then stopped.

Then, the control section 54 operates to print a third measuring pattern P3 as in the case of the printing of the first measuring pattern P1. Accordingly, the third measuring pattern P3 is formed on a position spaced apart from the second measuring pattern P2 by the distance D2.

Further, the control section 54 similarly controls the first driving roller 40 to rotate by 60 degrees in subsequent processes, in which the same nozzle ejects the black ink onto the sheet S in a standstill state to form the measuring patterns P.

Namely, at a rotational phase of 180 degrees, a fourth measuring pattern P4 is formed on a position spaced apart from the third measuring pattern P3 by a distance D3. At a rotational phase of 240 degrees, a fifth measuring pattern P5 is formed on a position spaced apart from the fourth measuring pattern P4 by a distance D4. At a rotational phase of 300 degrees, a sixth measuring pattern P6 is formed on a position spaced apart from the fifth measuring pattern P5 by a distance D5.

The measuring pattern is continuously formed through the intermittent transportation of the sheet S along with the rightward and leftward movements of the carriage 14 until the detection sensor 35 detects the posterior end (an end on the upstream side in the transport direction) of the sheet S.

Figure 6:
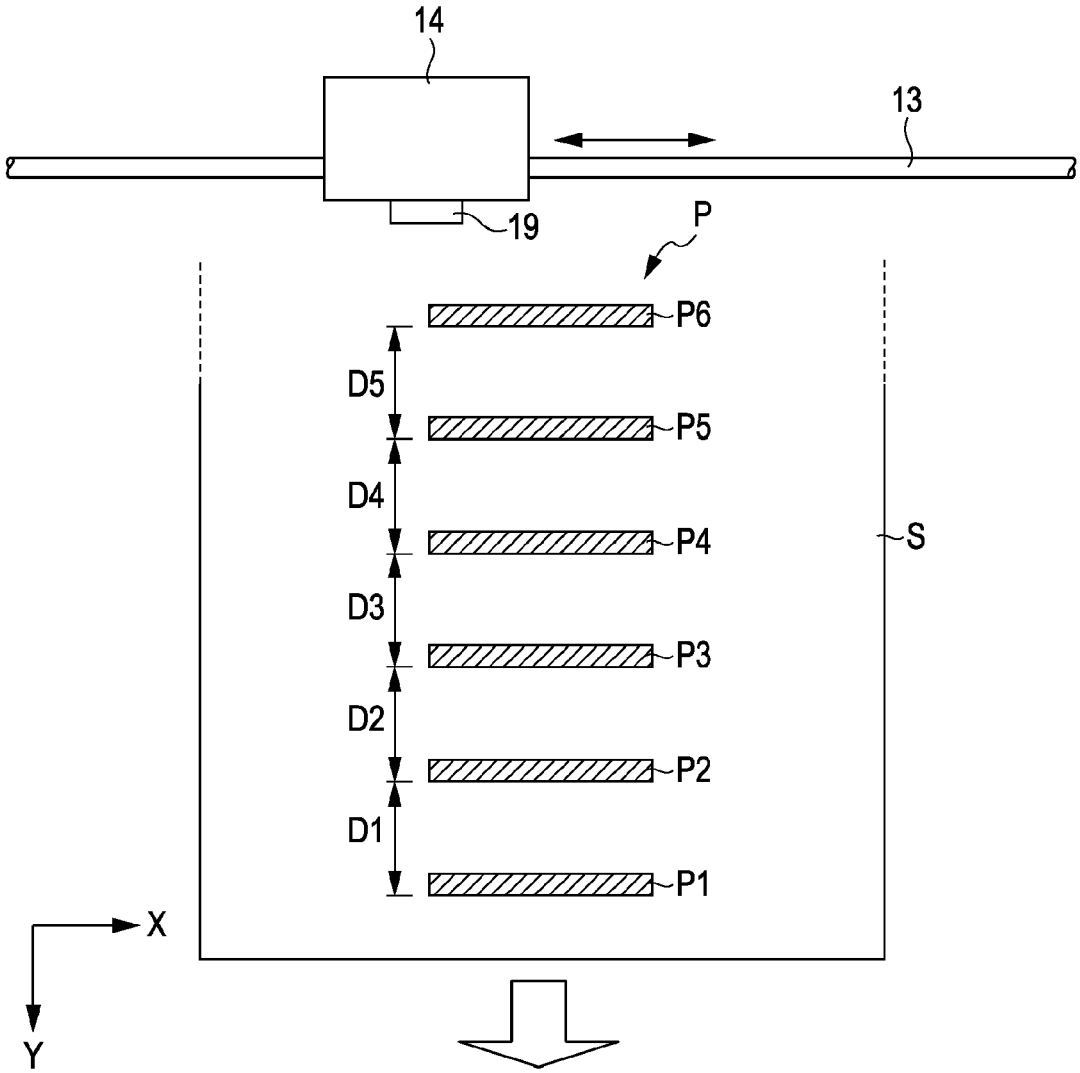
FIG. 6 illustrates a process for forming a measurement pattern.

Then, a plurality of the first to m-th measuring patterns P1 to Pm (m is an integer) are formed on the sheet S in the sub-scanning direction Y being spaced apart from each other by a distance Dn (n is an integer) (a case of up to m=6 and n=5 is illustrated in FIG. 6).

The distances D1 to Dn correspond to respective transport rates of the sheet S in the case where the first driving roller 40 is rotated by an equal rotational phase (60 degrees in the embodiment). Accordingly, the transport rate is constant in the case of the absence of an alignment error of the encoder scale 52 and/or the first driving roller 40. However, the transport rate continuously and periodically varies in the case of the presence of the alignment error.

Next, a method for calculating a variation in the transport rate error d from the measuring pattern P printed on the sheet S will be described below. The variation in the transport rate error d can be calculated in accordance with a difference between a reference distance Db and each distance Dn.

The reference distance is a distance which is given from an actual distance in which the sheet S is transported in a single rotation (rotation by 360 degrees) of the first driving roller 40 in proportion to a phase distance between each measuring pattern P (60 degrees). Namely, in the embodiment, because each phase interval (60 degrees) in the formation of each measuring pattern P is equal to each other, the reference distance Dd is a mean value which is obtained by dividing the actual distance corresponding to a single rotation of the first driving roller 40 by 6, where the numeral 6 is obtained through dividing the single rotation (360 degrees) by the phase interval (60 degrees).

Figure 7:
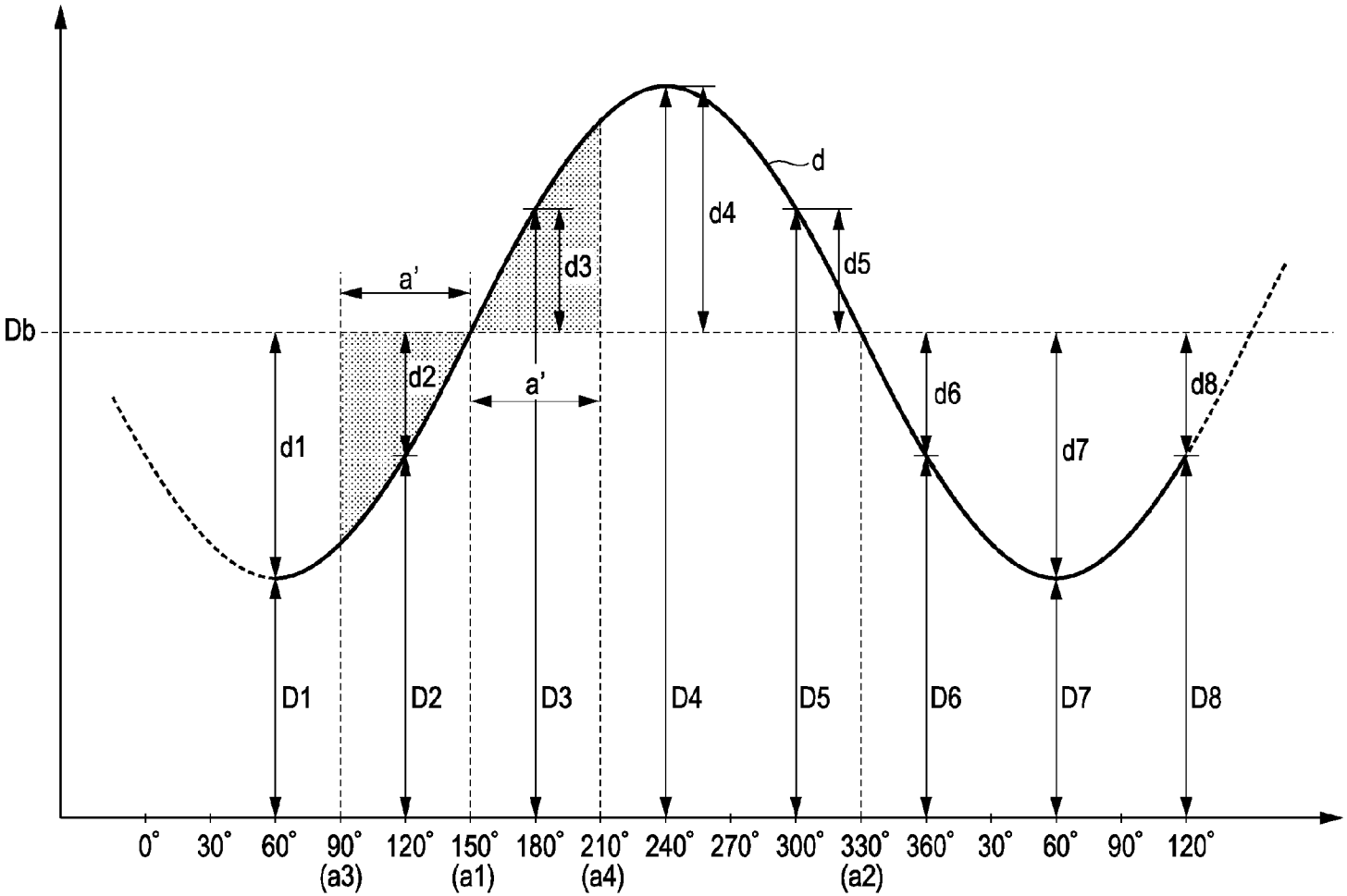
FIG. 7 is a graph illustrating variation in an error of a transport rate.

Because the calculated variation in the transport rate error d appears periodically in a curved shape every cycle of a single rotation of the first driving roller 40, a graph shown in FIG. 7 may be assumed, in which phases with a maximum absolute value of the transport rate error d are selected. Namely, the variation in the transport rate error d caused by an alignment error of the encoder scale 52 and/or the first driving roller 40 continuously and periodically occurs in a sine (cosine) curve form and changes with a cycle of 360 degrees.

FIG. 7 illustrates transport rate error d estimated in the case where nine measuring patterns P are formed on a single sheet S to measure a first to eighth distances D1 to D8. In the embodiment, a method for calculating a reference phase will be described below on the basis of an example in which each distance Dn has the following relationships: the first distance D1≦the second distance D2≦the third distance D3≦the fourth distance D4. As for the fifth to eighth distances D5 to D8, the fifth distance D5 is nearly equal to the third distance D3; the sixth distance D6, the eighth distance D8, and the second distance D2 are nearly equal to each other; and the seventh distance D7 is nearly equal to the first distance D1.

As shown in FIG. 7, the transport rate error d at a rotational phase corresponding to each measuring pattern P is expressed as follows: Firstly, the transport rate error d at a rotational phase of 60 degrees corresponding to the second measuring pattern P2 is represented as a first transport rate error d1 (d1=Db−D1).

A second transport rate error d2 (d2=Db−D2) is represented at a rotational phase of 120 degrees corresponding to the third measuring pattern P3. A third transport rate error d3 (d3=D3−Db) is represented at a rotational phase of 180 degrees corresponding to the fourth measuring pattern P4. A fourth transport rate error d4 (d4=D4−Db) is represented at a rotational phase of 240 degrees corresponding to the fifth measuring pattern P5. A fifth transport rate error d5 (d5=D5−Db) is represented at a rotational phase of 300 degrees corresponding to the sixth measuring pattern P6. A sixth transport rate error d6 (d6=Db−D6) is represented at a rotational phase of 360 (zero) degrees corresponding to a seventh measuring pattern P7 (not shown). A seventh transport rate error d7 (d7=Db−D7) is represented at a rotational phase of 420 (60) degrees corresponding to an eighth measuring pattern P8 (not shown). An eighth transport rate error d8 (d8=Db−D8) is represented at a rotational phase of 480 (120) degrees corresponding to a ninth measuring pattern P9 (not shown).

Accordingly, in the embodiment, because the reference distance Dd in each phase range is equal to each other, each transport rate error d has the following relationships: the first transport rate error d1≈the fourth transport rate error d4≈the seventh transport rate error d1≧the second transport rate error d2≈the third transport rate error d3≈the fifth transport rate error d5 the sixth transport rate error d6≈the eighth transport rate error d8.

The reference phase is a phase from which each of relative phases to the two rotational phases having a maximum transport rate error d is equal to each another. Accordingly, in the embodiment, a rotational phase of 150 degrees, which is displaced by a quarter cycle from a rotational phase of 60 degrees corresponding to the maximum transport rate error d, becomes a first reference phase a1.

Furthermore, in the embodiment, the seventh transport rate error d7 of the eighth measuring pattern P8 (not shown) is also substantially equal to the first transport rate error d1. The eighth measuring pattern P8 is formed through rotating 360 degrees (one cycle) from a rotational phase of 60 degrees at which the second measuring pattern P2 has been formed. Accordingly, a rotational phase of 330 degrees, which is obtained by averaging a rotational phase of 240 degrees and a rotational phase of 420 degrees at which the eighth measuring pattern P8 is formed, becomes similarly a second reference phase a2. However, because the rotational phase is reset at a rotational phase of 360 degrees where the phase sensor 53 detects the origin scale marking 51, the eighth measuring pattern P8 becomes to correspond to a rotational phase of 60 degrees.

The two reference phases a1 and a2 calculated in one cycle (rotation by 360 degrees) of the first driving roller 40 are stored in a nonvolatile memory (EEPROM), not shown, in the control section 54 as a storing unit.

A method for setting a correction value for the transport rate in the printer 11 on the basis of the reference phases a1 and a2 determined in the above manner will be described with reference to FIGS. 8 to 10.

In the case where a user changes a type of the sheet S, a sliding condition between the first driving roller 40 and the sheet S is changed, then the transport rate of the sheet S is changed in a single rotation of the first driving roller 40. Accordingly, a correction value for correcting the error between a transport distance Dr by which the first driving roller 40 actually transports the sheet S and a calculation distance Di which is a transport rate calculated according to the number of pulses, needs to be set again.

Specifically, the control section 54 drives the PF motor 25 to rotate the paper feed roller 33 so as to feed the sheet S which is set on the paper feed tray 23. Furthermore, the PF motor 25 is driven to control the rotation of the first driving roller 40 and the second driving roller 43, so that the fed sheet S is positioned on the platen 20.

In this case, the first driving roller 40 is rotated by at least 360 degrees or more. Namely, the origin scale marking 51 on the encoder scale 52, which rotates together with the first driving roller 40, passes the phase sensor 53 at least once. Accordingly, the phase sensor 53 detects the origin scale marking 51 to output its detection result, then the control section 54 initializes the rotational phase on the basis of the detection result, and stores in an RAM (not shown) the rotational phase which is obtained by detecting output pulses corresponding to the detection result of the scale markings 50.

The control section 54 stops the driving of the PF motor 25 such that the first driving roller 40 stops at a starting phase a3 (for example, 90 degrees in the embodiment) as a first rotational phase (a first transport process). The starting phase a3 is a phase which is arbitrarily determined such that the transport rate of the sheet S to be transported is smaller than a length of a nozzle array formed on the recording head 19 in the sub-scanning direction when the first driving roller 40 rotates by a rotational phase (120 degrees), which is twice a relative phase a' (60 degrees in the embodiment) between the starting phase a3 and the reference phase a1.

Figure 8:
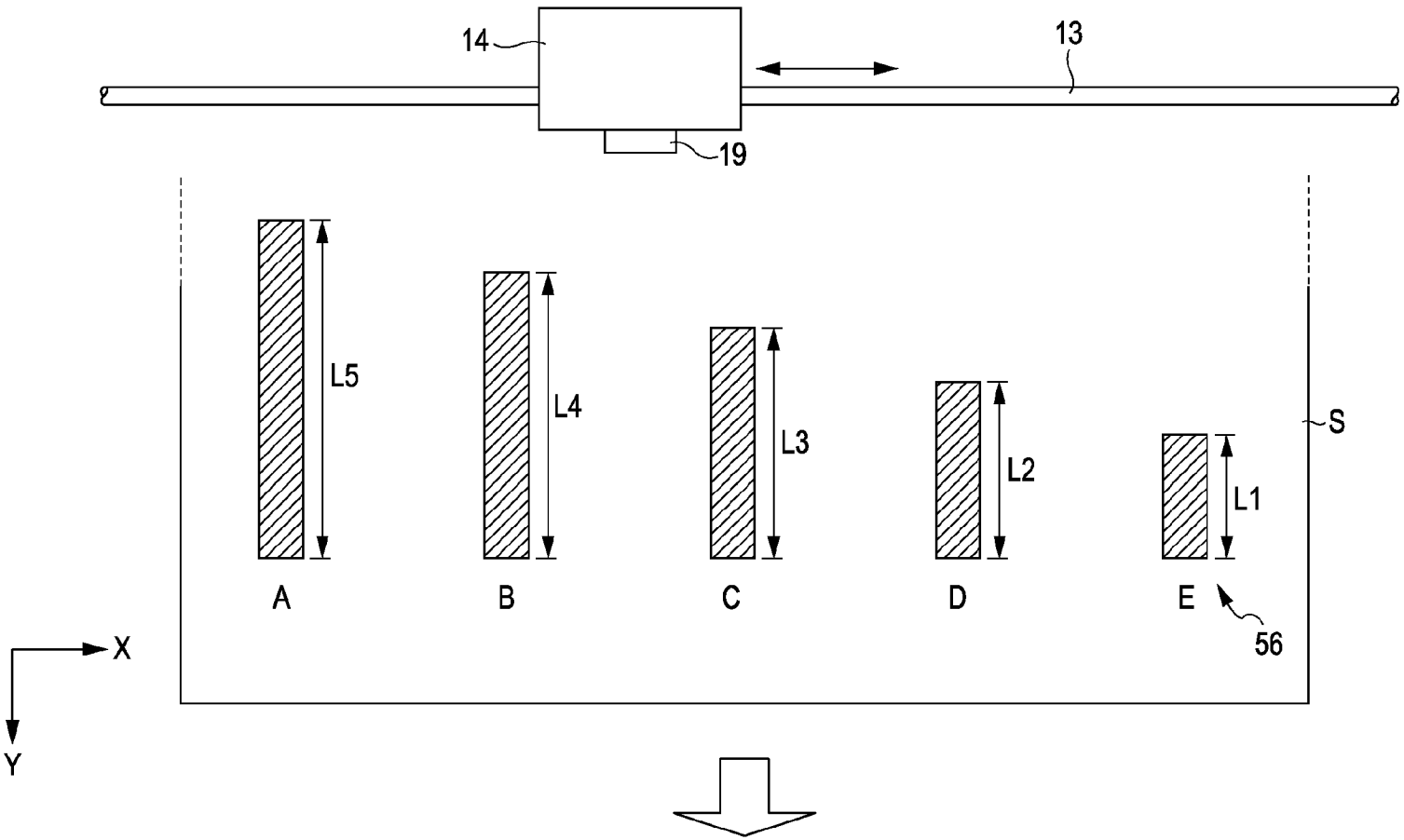
FIG. 8 illustrates a process for forming a correction pattern.

Subsequently, as shown in FIG. 8, the control section 54 controls the CR motor 18 to normally drive the motor therein, so that the carriage 14 positioned at the home position is moved in the leftward direction in FIG. 8. The control section 54 continuously outputs ejection signals to the recording head 19 in conjunction with the leftward movement of the carriage 14 in order to eject black ink from a nozzle corresponding to the black ink. Then, a first patterns 56 constituting a plurality (five in the embodiment) of correction patterns A to E shown in FIG. 8 are formed on the sheet S in a standstill state (a first recording process).

Note that the control section 54 outputs the ejection signals to the recording head 19 at predetermined intervals and instructs that an ink ejection nozzle should be changed according to the correction patterns A to E. Consequently, the first pattern 56 including five lines individually extending in lengths L1 to L5 in the sub-scanning direction Y is printed on the sheet S in a recording region corresponding to a region through which a nozzle array (not shown) formed on the recording head 19 passes in the main-scanning direction X, while the five lines are spaced apart from each other at predetermined intervals in the main-scanning direction X.

Specifically, the control section 54 selects a nozzle for ejecting ink among the nozzles included in the nozzle array, not using other four nozzles on the upstream side in the transport direction, so that the first pattern 56 having the length L1 is printed constituting a correction pattern E.

Subsequently, the control section 54 selects nozzles for ejecting ink among the nozzles included in the nozzle array, not using other three nozzles on the upstream side in the transport direction, so that the first pattern 56 having the length L2 is printed constituting a correction pattern D.

Namely, a difference in length between the lengths L1 and L2 in the first pattern 56 corresponds to a width of an ink droplet, which is ejected from a single nozzle and then is landed, in the sub-scanning direction. In addition, the transport of the sheet S can be controlled in a unit of distance (for example, 1 μm) shorter than the width of the ink droplet. Meanwhile, in order to describe a difference between the actual transport rate of the sheet S and the transport rate stored in the control section 54, FIG. 8 emphatically illustrates the difference between the lengths L1 and L2 in the first pattern 56.

Furthermore, the control section 54 selects nozzles for ejecting ink among the nozzles included in the nozzle array, not using other two nozzles on the upstream side in the transport direction of the sheet S, so that the first pattern 56 having the length L3 is printed constituting correction pattern C. Then, the control section 54 selects nozzles for ejecting ink among the nozzles included in the nozzle array, not using a nozzle positioned at the most upstream side in the transport direction of the sheet S, so that the first pattern 56 having the length L4 is printed constituting a correction pattern B.

Moreover, the control section 54 selects all the nozzles for ejecting ink, so that the first pattern 56 having the length L5 is printed constituting a correction pattern A. Accordingly, the length L5 of the first pattern 56 for the correction pattern A corresponds to a length of the nozzle array formed on the recording head 19 in the sub-scanning direction Y.

After the printing of the first pattern 56 has finished, then the control section 54 drives the PF motor 25. The driving of the PF motor 25 is stopped such that the first driving roller 40 stops at a finishing phase a4 (see, FIG. 7) for a second rotational phase on the basis of the result of the detection performed by the rotary encoder 49 (a second transport process). Then, the sheet S is downward transported by the distance Dr in the transport direction (the sub-scanning direction Y) indicated by a white arrow, and then stopped.

The finishing phase a4 is a phase whose relative phase a' to the reference phase a1 is equal to the relative phase a' (60 degrees) between the starting phase a3 and the reference phase a1. Accordingly, in the embodiment, the first driving roller 40 stops at a rotational phase of 210 degrees as the finishing phase a4 to which the first driving roller 40 has rotated from the starting phase a3 by 120 degrees.

Figure 9:
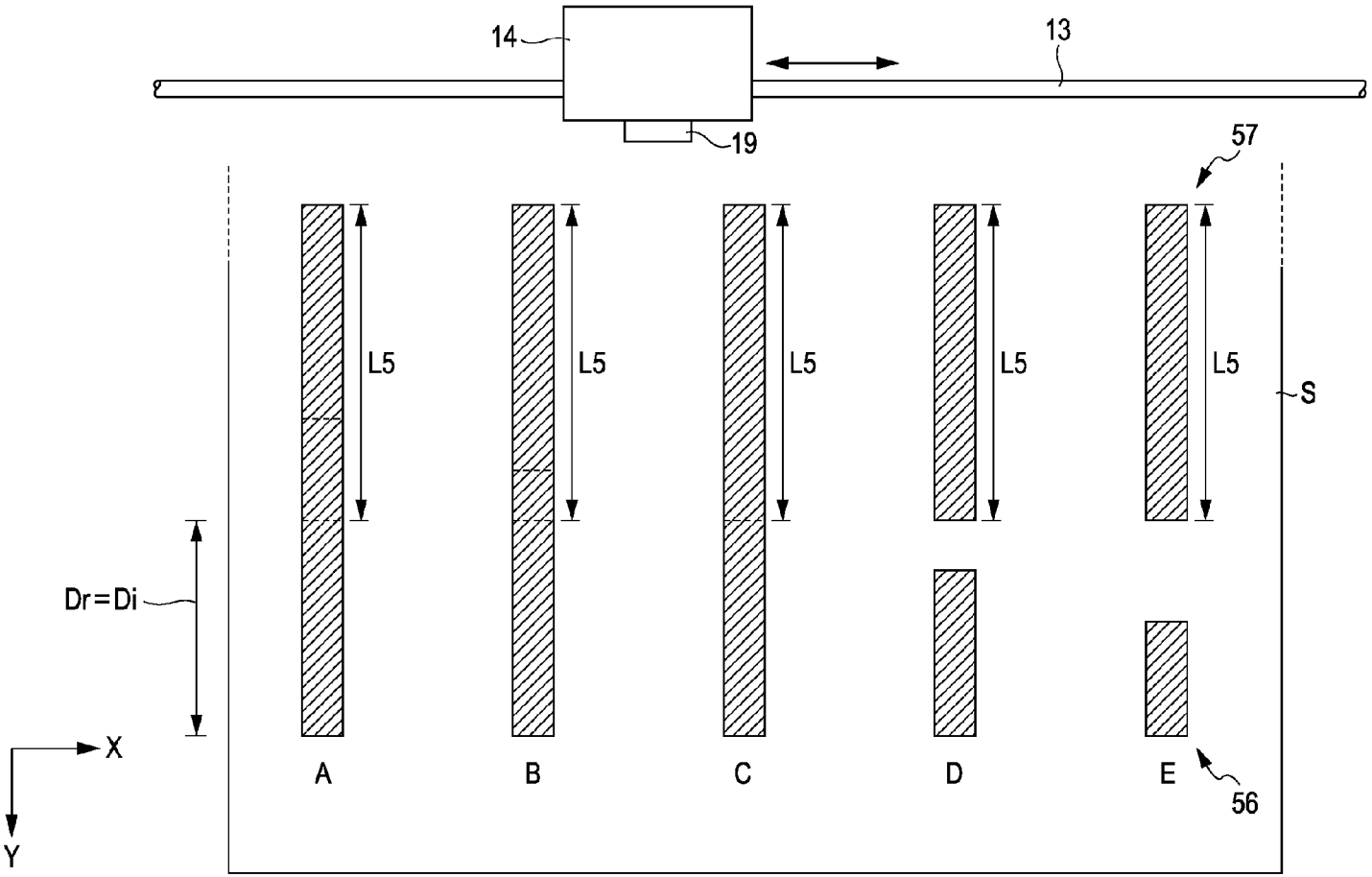
FIG. 9 illustrates a formed correction pattern.

As shown in FIG. 9, the control section 54 controls the CR motor 18 in this status to reversely drive the motor therein, so that the carriage 14 which is located at the leftmost position of the guiding shaft 13 due to the forward movement for forming the first pattern 56 is rightward moved to the rightmost position on the side of the home position. In accordance with the rightward movement of the carriage 14, the control section 54 outputs an ejection signal to the recording head 19 to eject black ink from all nozzles arranged on the recording head 19 onto the sheet S at the same intervals as those taken during the formation of the first pattern 56.

Then, a plurality (five in the embodiment) of second patterns 57 extending in the sub-scanning direction Y are formed on the sheet S (second recording process). Each length of the second patterns 57, formed by the ink which is ejected from all nozzles, is equal to the length L5 of the first pattern 56 constituting the correction pattern A in the sub-scanning direction.

In the embodiment, the first pattern 56 and the second pattern 57 are combined to configure the correction patterns A to E.

Meanwhile, FIG. 9 illustrates an example in which the transport distance Dr by which the sheet S is actually transported is identical to the calculation distance Di which is calculated on the basis of the pulse number obtained from the phase sensor 53 when the control section 54 has controlled the first driving roller 40 to rotate from the starting phase a3 to the finishing phase a4. Namely, in the case where the transport distance Dr is identical to the calculation distance Di, for example, the first pattern 56 and the second pattern 57 are continuously formed in the correction patterns A to C, and the first pattern 56 and the second pattern 57 are formed so as to be spaced apart from each other in the correction patterns D and E.

Figure 10:
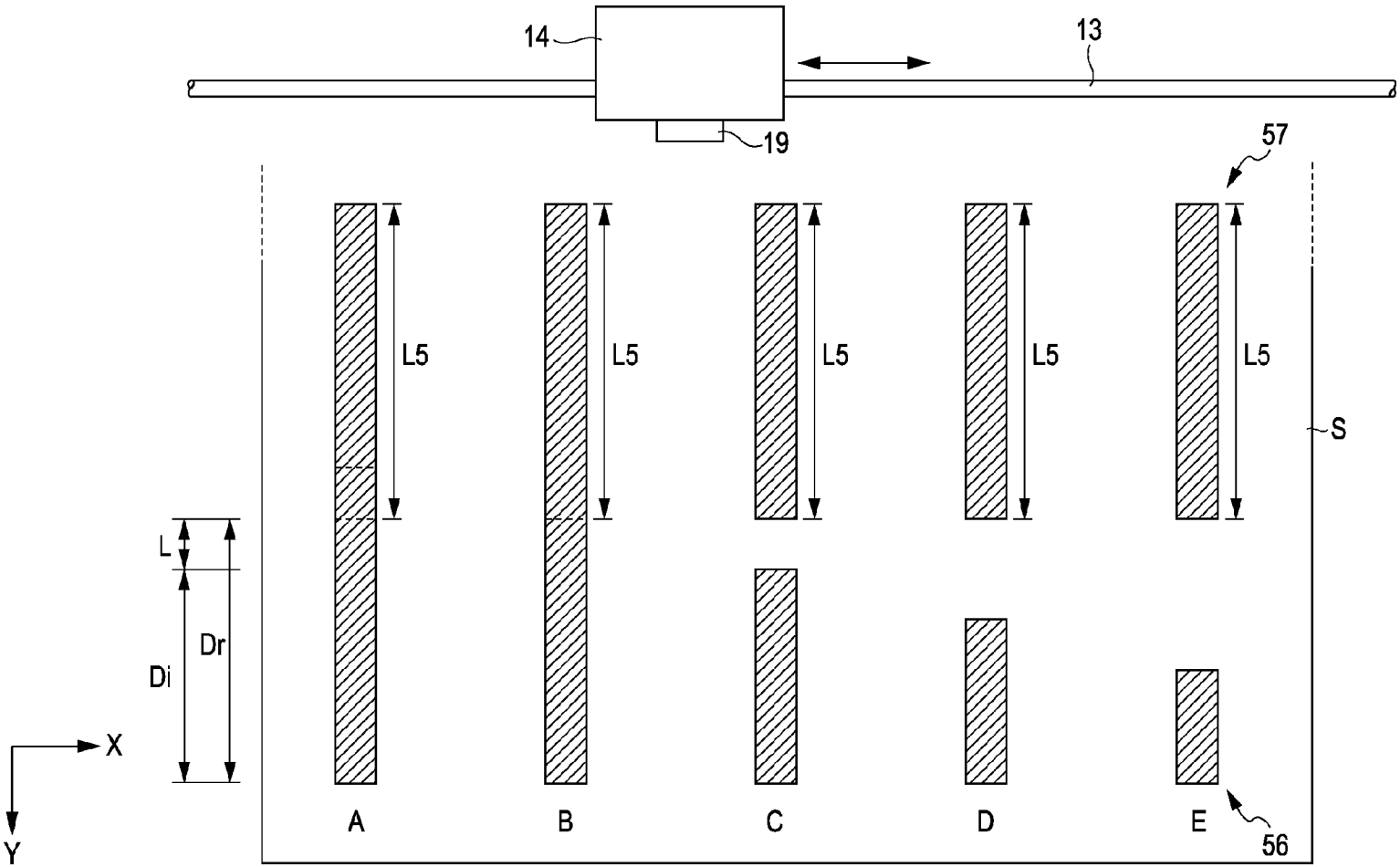
FIG. 10 illustrates a formed correction pattern.

However, as shown in FIG. 10, in the case where the transport distance Dr is longer than the calculation distance Di, a relative position relationship between the first pattern 56 and the second pattern 57 is varied. In the embodiment, for example, although the first pattern 56 and the second pattern 57 are continuously formed in the correction patterns A and B, the first pattern 56 and the second pattern 57 are formed so as to be spaced apart from each other in the correction patterns C to E.

Accordingly, a difference L ($L=|Dr-Di|$) corresponding to a difference in distance between the transport distance Dr and the calculation distance Di can be visually recognized in accordance with the positional relationship between the first pattern 56 and the second pattern 57. Accordingly, a user operates the operation section 55 to input one correction pattern (correction pattern B in FIG. 10) as pattern information in which the first pattern 56 and the second pattern 57 are continuously formed and less overlapped. Then a correction value corresponding to the pattern information is stored in a nonvolatile memory (EEPROM), not shown, in the control section 54.

The correction value is stored as a correction pulse number in a single rotation of the first driving roller 40. The difference L corresponding to a difference in distance between the transport distance Dr and the calculation distance Di is larger than a transport rate of the sheet S corresponding to one pulse, which is a minimum unit in which the rotary encoder 49 is capable of performing correction. In the embodiment, for example, the transport rate of the sheet S corresponding to a length of the difference L corresponds to three pulses.

As indicated by shaded regions in FIG. 7, in the case of the rotation from a rotational phase of 90 degrees in which the first pattern 56 has been formed to a rotational phase of 210 degrees in which the second pattern 57 has been formed, variation in the transport rate error d resulting from the error in alignment of the first driving roller 40 and the encoder scale 52 is cancelled out as the phase proceeds further from the reference phase a1.

Accordingly, in the embodiment, because a difference (difference L) of three pulses is generated in the rotation by 120 degrees, reduction of the rotation amount corresponding to nine pulses (three pulses×3 (3 is obtained by dividing 360 degrees by 120 degrees)) is stored as a correction value corresponding to the difference L between the transport distance Dr and the calculated distance Di in a single rotation of the first driving roller 40 (a correction value setting process).

Subsequently, printing onto the sheet S in the printer 11 having such a configuration will be hereinafter described with especially drawing attention to effect of the correction of the transport rate of the sheet S.

When a user operates the operate section 55 to perform printing, the control section 54 controls the PF motor 25 to operate. Then, the paper feed roller 33 rotates to feed the sheet S set on the paper feed tray 23, and the rotation of the first driving roller 40 and the second driving roller 43 is controlled to be stopped such that a print region of the sheet S is positioned on the platen 20. The first driving roller 40 is assumed to stop at a rotational phase of 90 degrees, for example.

In this case, the driving roller 40 rotates by at least 360 degrees or more and then stops. Namely, the origin scale marking 51 on the encoder scale 52, rotating together with the first driving roller 40, passes the phase sensor 53 at least once. Consequently, the phase sensor 53 detects the origin scale marking 51 to output its detection result, then the control section 54 initializes the rotational phase on the basis of the detection result, and stores in an RAM (not shown) the rotational phase which is obtained by detecting output pulses corresponding to the detection result of the scale markings 50.

The control section 54 controls the CR motor 18 to operate with the result that the carriage 14 is moved in the main-scanning direction. In addition, the control section 54 controls the recording head 19 to eject ink from the recording head 19, and the printing is performed.

After the printing has finished, the control section 54 drives the PF motor 25 so as to transport the sheet S in the sub-scanning direction Y by a distance corresponding to a width of a region in which the printing has been performed with the movement of the carriage 14 in the main-scanning direction.

In the embodiment, for example, the first driving roller 40 repeatedly rotates and stops by 240 degrees to intermittently transport the sheet S. Accordingly, the control section 54 detects the rotational phase on the basis of the pulse number output from the rotary encoder 49, and controls the first driving roller 40 to rotate up to 330 degrees, and then the first driving roller 40 stops.

In the embodiment, during the one rotation (rotation by 360 degrees) of the first driving roller 40, correction is performed to reduce the rotation amount for nine pulses (three pulses×3 (3 is obtained by dividing 360 degrees by 120 degrees)). Namely, in the case where the first driving roller 40 is rotated from a rotational phase of 90 degrees by 240 degrees, the control section 54 controls the roller 40 to stop at a position in which the rotation amount for six pulses (three pulses×2 (2 is obtained by dividing 240 degrees by 120 degrees)) is reduced relative to a rotational phase of 330 degrees.

The control section 54 controls the driving of the CR motor 18 and the recording head 19 to perform the printing on the sheet S in a standstill state in a print region extending continuously in the sub-scanning direction Y from the print region on which the printing has been performed, while moving the carriage 14 in the main-scanning direction X.

Subsequently, the control section 54 controls the PF motor 25 to operate, so that the first driving roller 40 is further rotated by 240 degrees to transport the sheet S to the downstream side in the transport direction. Namely, in the rotation of the first driving roller 40 which has stopped at the rotational phase of 330 degrees, the rotary encoder 49 outputs the detection result, and then the rotational phase is detected on the basis of the detection result, so that the first driving roller 40 stops at a rotational phase of 210 degrees. In this rotation, because the first driving roller 40 stops at a position in which the rotation amount for six pulses has been further reduced, in addition to the reduction for the six pulses in the previous rotation, the roller 40 stops at a position in which the rotation amount for totally 12 pulses has been reduced relative to the rotational phase of 210 degrees.

In this case, because the phase sensor 53 detects the origin scale marking 51, the rotational phase is reset at 360 degrees, but the numbers of decreased or increased pulses are maintained even after the passing of the origin scale marking 51.

Printing operation and transport operation are subsequently repeated in the same manner, and the sheet S is discharged with the paper discharge roller 38 after the printing has finished.

According to the embodiment, the following advantages can be achieved.

Because the correction patterns A to E are configured so as to be formed on the basis of the reference phases a1 and a2, even though the transport rate error d of the sheet S is varied in the first driving roller 40, the transport rate of the sheet S transported by a single rotation of the first driving roller 40 is capable of being obtained from one correction pattern in which the first pattern 56 and the second pattern 57 are continuously printed. Namely, the correction patterns A to E, which enable the transport rate in a single rotation of the first driving roller 40 to be estimated, can be formed without the first driving roller 40 being actually rotated by 360 degrees. Accordingly, growing in size of the apparatus can be suppressed, and individual differences of the transport rate of the sheet S in individual apparatuses can easily be measured.

The variation in the transport rate error d of the sheet S in a cycle of one rotation of the first driving roller 40 results from an error in alignment of the first driving roller 40 or the like, and is inherent in the apparatus having such an error in alignment. Consequently, the reference phases a1 and a2, which are determined for the first driving roller 40 on the basis of the variation in the transport rate error d, are to be uniquely determined in individual apparatuses. On the other hand, the transport rate of the sheet S transported by a single rotation of the transport roller 40 is affected by, for example, conditions in which the roller 40 abuts on the sheet S or the like, thereby resulting in being changed depending on recording conditions. Consequently, according to this configuration, the reference phases a1 and a2 inherent in individual apparatuses are stored in the control section 54, so that the reference phases a1 and a2 stored in the control section 54 can be used in every formation of the correction patterns A to E with the result that the correction patterns A to E can easily be formed.

Because the sheet S is transported on the basis of any one of the two reference phases a1 and a2, for example, using a nearer reference phase in a rotational direction of the first transport roller 40 enables unnecessary transport of the sheet S to be suppressed. Consequently, consumption of the sheet S can be suppressed.

Transport rates in the reference phases a1 and a2 can be measured on the basis of a formation state of the first and the second patterns 56 and 57, and the reference phases a1 and a2. In addition, because the transport rate in the reference phases a1 and a2 corresponds to an average transport rate in a single rotation of the first driving roller 40, a correction value is determined on the basis of the transport rate in the reference phases a1 and a2, so that the variation in the transport rate of the sheet S in a single rotation of the first driving roller 40 can easily be reduced, the variation being changed depending on individual differences and printing conditions in individual apparatuses.

The above embodiment may be modified as in the followings.

In the embodiment, the control section 54 may be configured so as to store either one of the reference phase a1 or a2.

In the embodiment, the control section 54 may be configured so as to calculate the reference phases in every measurement of correction values without storing the reference phases a1 and a2.

In the embodiment, because the distance Dn is sinusoidally changed, a rotational phase having a maximum distance Dn and a rotational phase having a minimum distance Dn are displaced from each other by a half cycle (180 degrees). Accordingly, phases which are displaced from either one of the rotational phase having the maximum distance Dn or the rotational phase having the minimum distance Dn, by a quarter cycle (90 degrees) in both directions in which the rotational phase increases and decreases, may be determined as the reference phases a1 and a2.

In the embodiment, although a plurality of the measuring patterns P are printed and actually measured to obtain the transport rate error d in the distance Dn corresponding to the transport rate of the sheet S, the invention is not limited to the above method that forms the pattern in the embodiment in so far as the transport rate error d and the rotational phase of the rotary encoder 49 can be obtained.

In the embodiment, although the paper transport roller 37 and the paper discharge roller 38 as a transporting unit are respectively disposed on the upstream side and the downstream side in the transport direction sandwiching the platen 20, a configuration in which either one of the rollers is disposed may be employed. Furthermore, it may be configured such that an endless transport belt having a width larger than that of the sheet S in the main-scanning direction is wound onto the first driving roller 40 and the second driving roller 43 to transport the sheet S while placing the sheet S on the belt.

In the embodiment, although a recording apparatus is embodied as the ink jet printer 11, it may employ a liquid ejecting apparatus that ejects or discharges a liquid other than ink. The invention may be applied to various liquid ejecting apparatuses having a liquid ejecting head or the like that ejects a slight amount of an ink droplet. The term "ink droplet" indicates a state of liquid ejected from the liquid ejecting apparatus and includes a liquid particle, a teardrop-shaped liquid, and a tailing liquid in a string shape. The liquids referred to herein may be materials which can be ejected from a liquid ejecting apparatus. For example, it may be a substance which is in a state of a liquid phase; examples of the liquid phase include a liquid having high or low viscosity, sol, gel water, other inorganic solvents, an organic solvent, solution, a liquid resin, and a liquid metal (metallic melt), and also include not only a liquid as one state of substances but substances in which particles of a functional material composed of a solid material such as a pigment and a metal particle are dissolved or dispersed in a solvent or mixed in the solvent. Typical examples of the liquid include ink described in the above embodiment and a liquid crystal. The ink referred to herein includes various liquid compositions such as generic aqueous or oil-based ink, generic gel ink, and hot melt ink. Specific examples of the liquid ejecting apparatus may include, for example; a liquid ejecting apparatus that ejects liquid containing dispersed or dissolved materials such as an electrode material and a color material used in manufacturing a liquid crystal display, an electroluminescence (EL) display, a surface-emitting display, and a color filter; a liquid ejecting apparatus that ejects a bioorganic substance used in manufacturing a biochip; a liquid ejecting apparatus that is used as a precision pipette and ejects a liquid as a specimen; a print apparatus; and a micro-dispenser. Furthermore, it may employ: a liquid ejecting apparatus that ejects a lubricant to a precision instrument such as a watch and a camera with pinpoint accuracy; a liquid ejecting apparatus that ejects a transparent resin such as an ultraviolet curing resin onto a substrate to form a micro hemispherical lens (optical lens) used for an optical communication device; and a liquid ejecting apparatus that ejects acidic or alkaline etchant for etching a substrate. The invention may be applied to any one of the above liquid ejecting apparatuses.

What is claimed is:

1. A recording apparatus comprising:

a transporting unit that transports a sheet from an upstream side to a downstream side in a transport direction with a transport roller;

a driving unit that drives the transporting unit;

a phase detecting unit that detects a phase origin of the transport roller rotating in accordance with the driving of the driving unit and a rotational phase indicating an amount of rotation from the phase origin;

a recording unit that performs recording on the sheet transported with the transporting unit; and a control unit that controls the driving unit such that the transport roller rotates within a certain transport range based on a preliminarily set reference phase, forms a first pattern by controlling the recording unit at a first rotation phase at a control start point of the driving unit, forms a second pattern by controlling the recording unit at a second rotation phase at a control end point of the driving unit, and then forms a correction pattern including the first and second patterns.

* * * * *